US007956831B2

(12) United States Patent
Roush et al.

(10) Patent No.: US 7,956,831 B2
(45) Date of Patent: Jun. 7, 2011

(54) APPARATUS, SYSTEMS, AND METHODS FOR DIMMING AN ACTIVE MATRIX LIGHT-EMITTING DIODE (LED) DISPLAY

(75) Inventors: Jerry A. Roush, Phoenix, AZ (US); Kalluri R. Sarma, Mesa, AZ (US); John F. L. Schmidt, Phoenix, AZ (US)

(73) Assignee: Honeywell Interntional Inc., Morristown, NJ (US)

( * ) Notice: Subject to any disclaimer, the term of this patent is extended or adjusted under 35 U.S.C. 154(b) by 709 days.

(21) Appl. No.: 11/755,562

(22) Filed: May 30, 2007

(65) Prior Publication Data

US 2008/0297452 A1 Dec. 4, 2008

(51) Int. Cl.
*G09G 3/32* (2006.01)

(52) U.S. Cl. ..... 345/82; 345/83

(58) Field of Classification Search ..... 345/42, 345/46, 48, 63, 77, 95, 204, 205, 210, 214, 345/690, 36, 55, 76, 82, 87, 92, 94, 208, 345/591, 691, 694, 83; 315/169.3; 358/509; 348/645

See application file for complete search history.

(56) References Cited

U.S. PATENT DOCUMENTS

| | | | | |
|---|---|---|---|---|
| 4,648,064 | A * | 3/1987 | Morley | 710/45 |
| 4,691,144 | A * | 9/1987 | King et al. | 315/169.3 |
| 5,317,307 | A * | 5/1994 | Thomas, Jr. | 340/815.45 |
| 5,666,132 | A * | 9/1997 | Ochi et al. | 345/96 |
| 5,952,806 | A * | 9/1999 | Muramatsu | 318/568.12 |
| 6,069,598 | A * | 5/2000 | Hansen | 345/74.1 |
| 6,157,375 | A * | 12/2000 | Rindal et al. | 345/208 |
| 7,038,671 | B2 * | 5/2006 | Willis et al. | 345/205 |
| 7,145,581 | B2 * | 12/2006 | Willis | 345/691 |
| 7,535,441 | B2 * | 5/2009 | Smith et al. | 345/76 |
| 7,663,579 | B2 * | 2/2010 | Jung et al. | 345/76 |
| 7,663,589 | B2 * | 2/2010 | Ha et al. | 345/92 |
| 7,760,163 | B2 * | 7/2010 | Jo | 345/76 |
| 2002/0041502 | A1 * | 4/2002 | Ulinksi et al. | 363/37 |
| 2003/0160803 | A1 * | 8/2003 | Willis | 345/691 |
| 2003/0160804 | A1 * | 8/2003 | Willis et al. | 345/694 |
| 2004/0041825 | A1 * | 3/2004 | Willis | 345/694 |
| 2004/0046752 | A1 * | 3/2004 | Willis et al. | 345/204 |
| 2004/0095297 | A1 * | 5/2004 | Libsch et al. | 345/76 |

(Continued)

OTHER PUBLICATIONS

EP Search Report, EP 08156846.8 dated Mar. 15, 2010.

*Primary Examiner* — Prabodh M Dharia
(74) *Attorney, Agent, or Firm* — Ingrassia Fisher & Lorenz, P.C.

(57) ABSTRACT

Apparatus, systems, and methods are provided for dimming pixels on an active matrix light-emitting diode display. One apparatus includes an LED couplable between a voltage source and ground. First and second pulse-width modulation (PWM) drivers are also coupled to the LED. A system includes a plurality of LEDs forming a plurality of rows coupled between a voltage source and ground. A plurality of PWM drivers, each coupled to each of the LEDs in one of the plurality of rows, and a global PWM driver coupled to each of the plurality of LEDs in each of the plurality of rows are also included. One method includes providing current to each LED of a row of LEDs for a first portion of a cycle via a PWM driver, and providing current to each LED in the row for a second portion of the cycle via a different PWM driver.

14 Claims, 15 Drawing Sheets

U.S. PATENT DOCUMENTS

2004/0212847 A1* 10/2004 Bliley et al. ..... 358/474
2004/0264948 A1* 12/2004 Lin et al. ..... 388/804
2005/0083274 A1* 4/2005 Beddes et al. ..... 345/82
2005/0093622 A1* 5/2005 Lee ..... 330/10
2005/0104820 A1 5/2005 Komiya
2005/0122292 A1* 6/2005 Schmitz et al. ..... 345/83
2006/0002123 A1* 1/2006 Hutzel et al. ..... 362/494
2006/0050032 A1* 3/2006 Gunner et al. ..... 345/82
2006/0109205 A1* 5/2006 Deng ..... 345/46
2006/0164345 A1 7/2006 Sarma et al.
2006/0164366 A1* 7/2006 Yu et al. ..... 345/98
2006/0244396 A1* 11/2006 Bucur ..... 315/312
2006/0256038 A1* 11/2006 Whight ..... 345/55
2007/0013356 A1* 1/2007 Qiu et al. ..... 323/288
2007/0052636 A1* 3/2007 Kalt et al. ..... 345/83
2007/0091111 A1* 4/2007 Gutta ..... 345/591
2007/0115304 A1* 5/2007 Lewis ..... 345/691
2007/0159421 A1* 7/2007 Peker et al. ..... 345/82
2007/0171271 A1* 7/2007 Wey et al. ..... 347/237
2007/0296663 A1* 12/2007 Goetz et al. ..... 345/87
2008/0062158 A1* 3/2008 Willis ..... 345/204
2008/0174527 A1* 7/2008 Hattori ..... 345/76
2008/0192499 A1* 8/2008 Gardner et al. ..... 362/488
2008/0224625 A1* 9/2008 Greenfeld ..... 315/201

* cited by examiner

APPARATUS, SYSTEMS, AND METHODS FOR DIMMING AN ACTIVE MATRIX LIGHT-EMITTING DIODE (LED) DISPLAY

FIELD OF THE INVENTION

The present invention generally relates to light-emitting diodes (LEDs), and more particularly relates to apparatus, systems, and methods for dimming an active matrix array of LEDs.

BACKGROUND OF THE INVENTION

FIG. 1 is a schematic diagram of a conventional pixel 100 of an active matrix light-emitting diode (AMLED) display. Pixel 100 includes a light-emitting diode (LED) 105 (e.g., an organic LED or other type of LED), a column driver 108, row drivers 110 and 115 (each coupled to ground), voltage sources 120 and 125 (each coupled to ground), a capacitor 130, and switches 142, 144, 146, and 148 (e.g., semiconductor switches).

The cathode of LED 105 is coupled to the negative terminal of voltage source 120 (the positive terminal being coupled to ground), or directly to ground, while the anode of LED 105 is coupled to a pixel drive transistor (e.g., a switch 142). Switch 142 is also coupled to a node 152, and node 152 is also coupled to switches 144 and 148. Switch 142 is turned ON/OFF by column driver 108 (via switch 146 and a node 156) and capacitor 130 via a node 154.

Switch 148 is coupled to node 156, and is turned ON/OFF by row driver 115 (via a node 158). Node 156 is also coupled to switch 146, and switch 146 is turned ON/OFF by row driver 115 (via node 158).

Pixel 100 also includes a node 160 coupled to switch 144, capacitor 130, and the positive terminal of voltage source 125 (the negative terminal being coupled to ground). Switch 144 is coupled to and turned ON/OFF by row driver 110.

During operation, row driver 115 turns ON switches 146 and 148 to program pixel 100. When switch 146 is ON, current from column driver 108 charges capacitor 130 and provides a voltage at the gate of switch 142, which turns ON switch 142. When switches 148 and 142 are each ON (at the same time as switch 146), current from column driver 108 is supplied to LED 105 (via switch 142) and LED 105 is illuminated.

Row driver 115 then turns OFF switches 146 and 148, and row driver 110 turns ON switch 144 (switch 142 remains ON via capacitor 130). When switches 142 and 144 are both ON, current from voltage source 125 is supplied to LED 105. This is referred to as the "Hold" portion of the cycle. LED 105 remains illuminated until row driver 110 turns OFF switch 144.

The brightness of LED 105 is determined not only by the magnitude of the current supplied, but also by the amount of time current is supplied to LED 105. That is, the longer the period of time LED 105 receives current during the cycle time, the brighter LED 105 appears. Similarly, the shorter the period of time LED 105 receives current, the dimmer LED 105 appears.

A conventional display (not shown) using an array of pixels 100 illuminates the array one row of pixels at a time (via a pair of row drivers 110 and 115 for each respective row) during a cycle time. Furthermore, once illuminated, each row remains illuminated until it is reprogrammed during the next cycle. That is, for each cycle row 1 is illuminated first via a first pair of row drivers, row 2 is then illuminated via a second pair of row drivers, and then row 3 is illuminated via a third pair of row drivers. This process continues until each row is illuminated via a respective pair of row drivers, and each row remains illuminated throughout its cycle.

FIG. 2 illustrates a timing diagram 200 of a conventional array of pixels 100 arranged in a plurality of rows. Timing diagram 200 shows one cycle time, which is typically about 16.6 milliseconds (ms). As illustrated, row 1 is illuminated at time $T_0$ and held ON for the remainder of the cycle time. After row 1 is illuminated, row 2 is illuminated at a time $T_R$ (e.g. 0.5 ms) after $T_0$ and held on until its next programming time. As discussed above, this process is repeated for each row until all of the rows in the array are illuminated.

Dimming of the display's luminance while retaining displayed information (e.g. gray shades) may be accomplished by modulating the amplitude of voltage supplies 120 and/or 125, or by turning either supply 125 or 105 OFF at an interval shorter than the cycle time. This is referred to as pulse width modulation of the LED 105 current.

Since each pair of row drivers illuminates the pixels 100 in their respective rows one row at a time, each row may be illuminated for a different amount of time if the PWM is not properly synchronized with each row's programming and hold periods. Furthermore, transients caused by the turning ON or OFF of switch 144 cause a change in the amount of charge on capacitor 130, and a corresponding change in the programmed current through switch 142 resulting in an undesired change in luminance of LED 105, thus causing luminance non-uniformity in the LED 105 array. Moreover, the ability to control the brightness of each LED is limited to the ability to precisely control the amount of current provided to the LED by the current source.

Accordingly, it is desirable to employ apparatus, systems, and methods for dimming the brightness of an array of pixels uniformly without the problems associated with the prior art methods. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

Various exemplary embodiments of the invention provide pixels for an active matrix light-emitting diode display that can be dimmed with uniform luminance. One pixel comprises an LED couplable between a voltage source and ground. The pixel also comprises a first pulse-width modulation (PWM) driver and a second PWM driver coupled to the LED.

Systems for dimming an array of pixels on an active matrix light-emitting diode display are also provided. A system comprises a plurality of LEDs forming a plurality of rows coupled between a voltage source and ground. A plurality of PWM drivers, wherein each of the plurality of PWM drivers is coupled to each of the LEDs in one of the plurality of rows is also included. A global PWM driver is also coupled to each of the plurality of LEDs in each of the plurality of rows.

Various exemplary embodiments also provide methods for dimming an array of pixels forming a plurality of rows on an active matrix light-emitting diode display. One method comprises providing current to each LED of a first row of LEDs for a first portion of a cycle via a first PWM driver, and providing current to each LED of the first row for a second portion of the cycle via a second PWM driver.

BRIEF DESCRIPTION OF THE DRAWINGS

The present invention will hereinafter be described in conjunction with the following drawing figures, wherein like numerals denote like elements.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1:
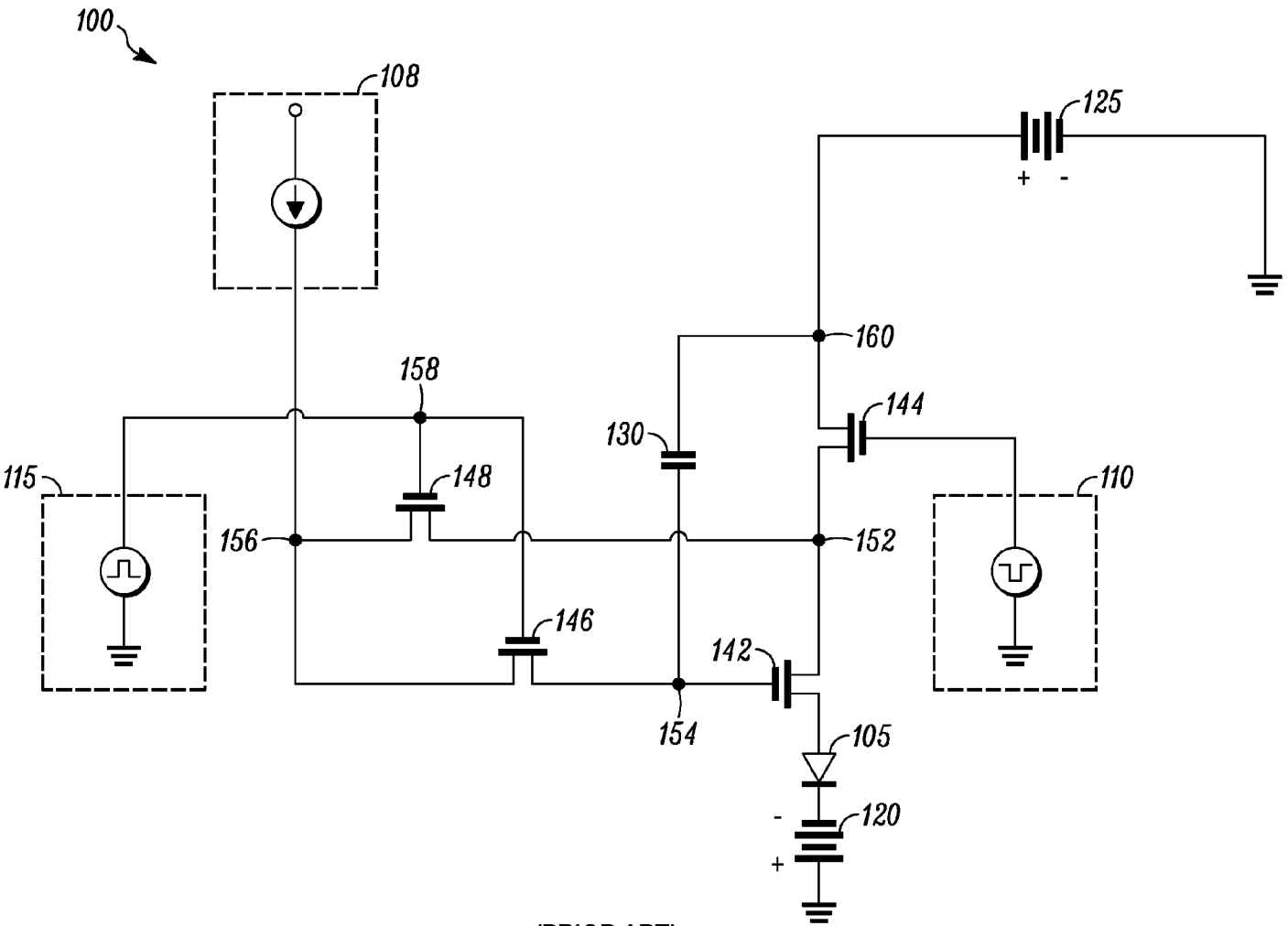
(PRIOR ART) FIG. 1
FIG. 1 is a schematic diagram of a prior art pixel of an active matrix light-emitting diode (AMLED) display.
Figure 2:
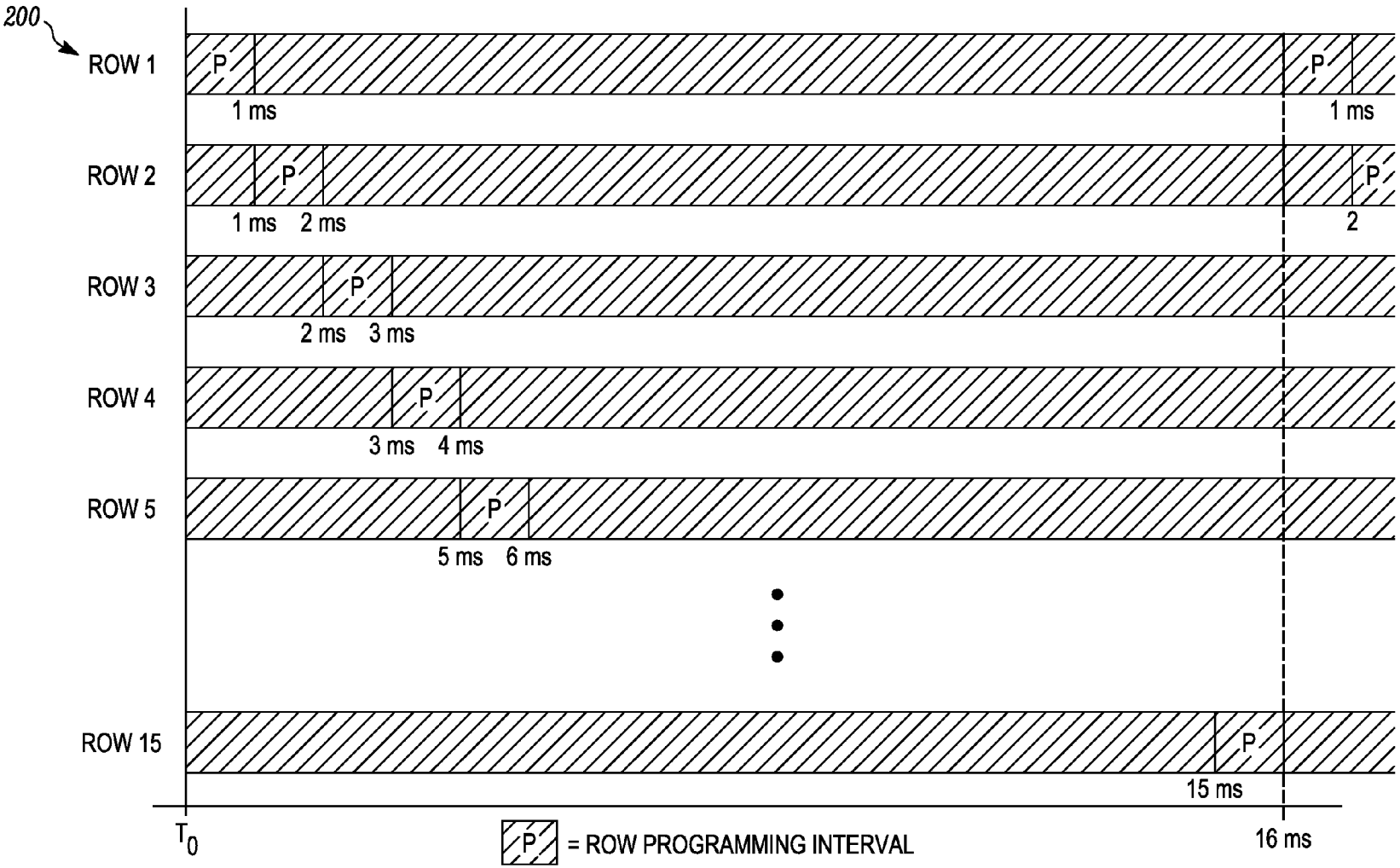
(PRIOR ART) FIG. 2
FIG. 2 is a timing diagram of a display comprising an array of the pixel of FIG. 1.
Figure 3:
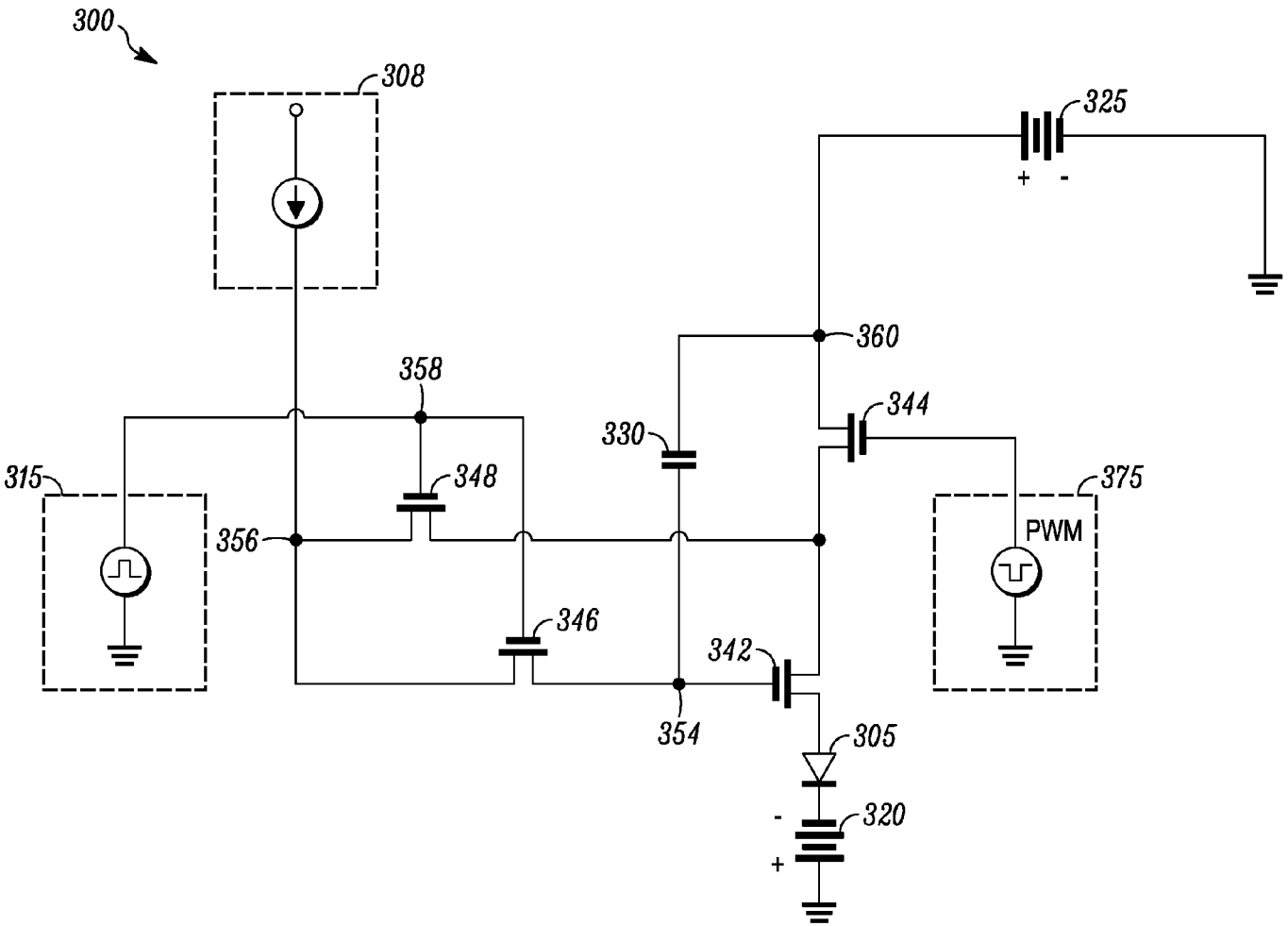
FIG. 3 is a schematic diagram of a pixel of an AMLED display in accordance with one exemplary embodiment of the invention.

FIG. 3 is a schematic diagram of one exemplary embodiment of a pixel 300 of an active matrix light-emitting diode (AMLED) display. Pixel 300 includes a light-emitting diode (LED) 305 (e.g., an organic LED or other type of LED), a column driver 308, a row driver 315, voltage sources 320 and 325, a capacitor 330, and switches 342, 344, 346, and 348 (e.g., semiconductor switches) arranged similar to LED 105, column driver 108, row driver 115, voltage sources 120 and 125, capacitor 130, and switches 142, 144, 146, and 148 of FIG. 1, respectively.

Pixel 300 also includes a pulse-width modulator (PWM) 375 coupled to switch 344 and ground. PWM 375 is configured to switch ON/OFF switch 344 so that LED 305 is illuminated for either a portion or the remainder of the cycle, depending on the desired dimming level, after row driver 315 has enabled programming of the current through LED 305.

Figure 4:
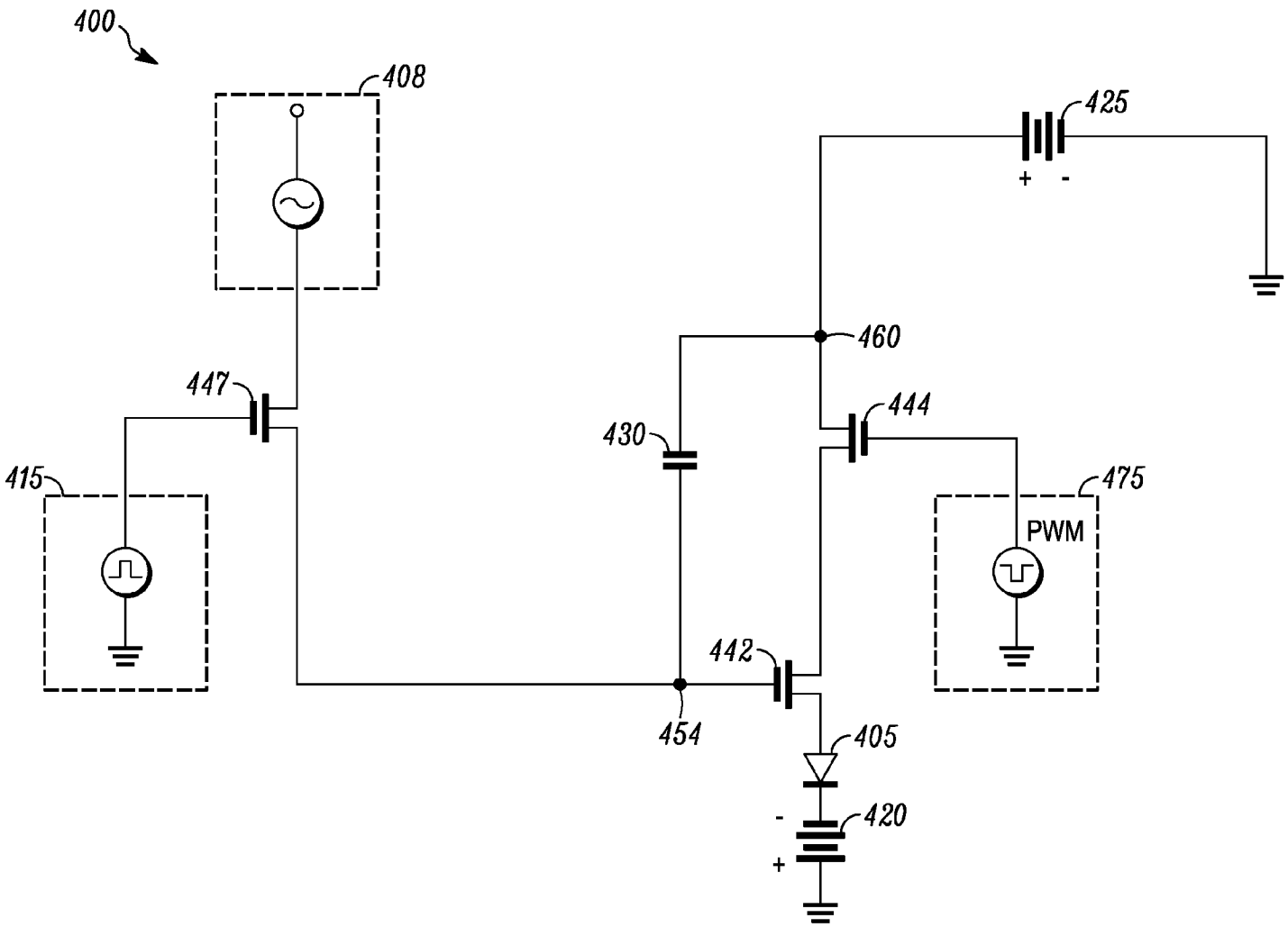
FIG. 4 is a schematic diagram of a pixel of an AMLED display in accordance with another exemplary embodiment of the invention.

FIG. 4 is a schematic diagram of a pixel 400 of an AMLED display in accordance with another exemplary embodiment of the invention. Pixel 400 includes an LED 405 (e.g., an organic LED or other type of LED), voltage sources 420 and 425, a capacitor 430, and switches 442 and 444 (e.g., semiconductor switches), and a PWM 475 arranged similar to LED 305, voltage sources 320 and 325, capacitor 330, switches 342 and 344, and PWM 375 of FIG. 3, respectively.

Pixel 400 also includes a switch 447 (e.g., a semiconductor switch) coupled to node 454. Switch 447 is also coupled to and turned ON/OFF by a row driver 415 similar to row driver 315 (see FIG. 3). Furthermore, switch 447 is coupled to a column driver 408 similar to column driver 308 (see FIG. 3) and configured to enable voltage from column driver 408 to charge capacitor 430 and activate switch 442 when switch 447 is ON.

Various embodiments of the invention provide an AMLED display 550 (see FIG. 5) comprising an array 510 of pixels 500 (e.g., pixels 300 and 400). Array 510 is arranged in a plurality of rows 515 and columns 520. The illumination of each row is controlled by a different PWM 575 and is illuminated one row at a time. In contrast to conventional displays, each PWM 575 is configured to illuminate each row 515 for the same amount of time at different times in the display's refresh cycle.

For example, a display comprising 15 rows of pixels 500 illuminates a row every 1.0 ms. That is, row $\mathbf{515}_1$ may be illuminated at time $T_0$ for 9 ms (i.e., until 9 ms after $T_0$). At time $T_1$ (i.e., 1.0 ms after $T_0$), row $\mathbf{515}_2$ is illuminated for 9 ms (i.e., until 10 ms after $T_0$). This process continues until row $\mathbf{515}_{15}$ is illuminated at $T_{15}$ (e.g., 15 ms after $T_0$) for 9 ms (i.e., 24 ms after $T_0$). Since the cycle period in this example is 16 ms, the pixels in row $\mathbf{515}_{15}$ will continue to emit light for 8.0 ms into the subsequent display cycle.

Figure 6:
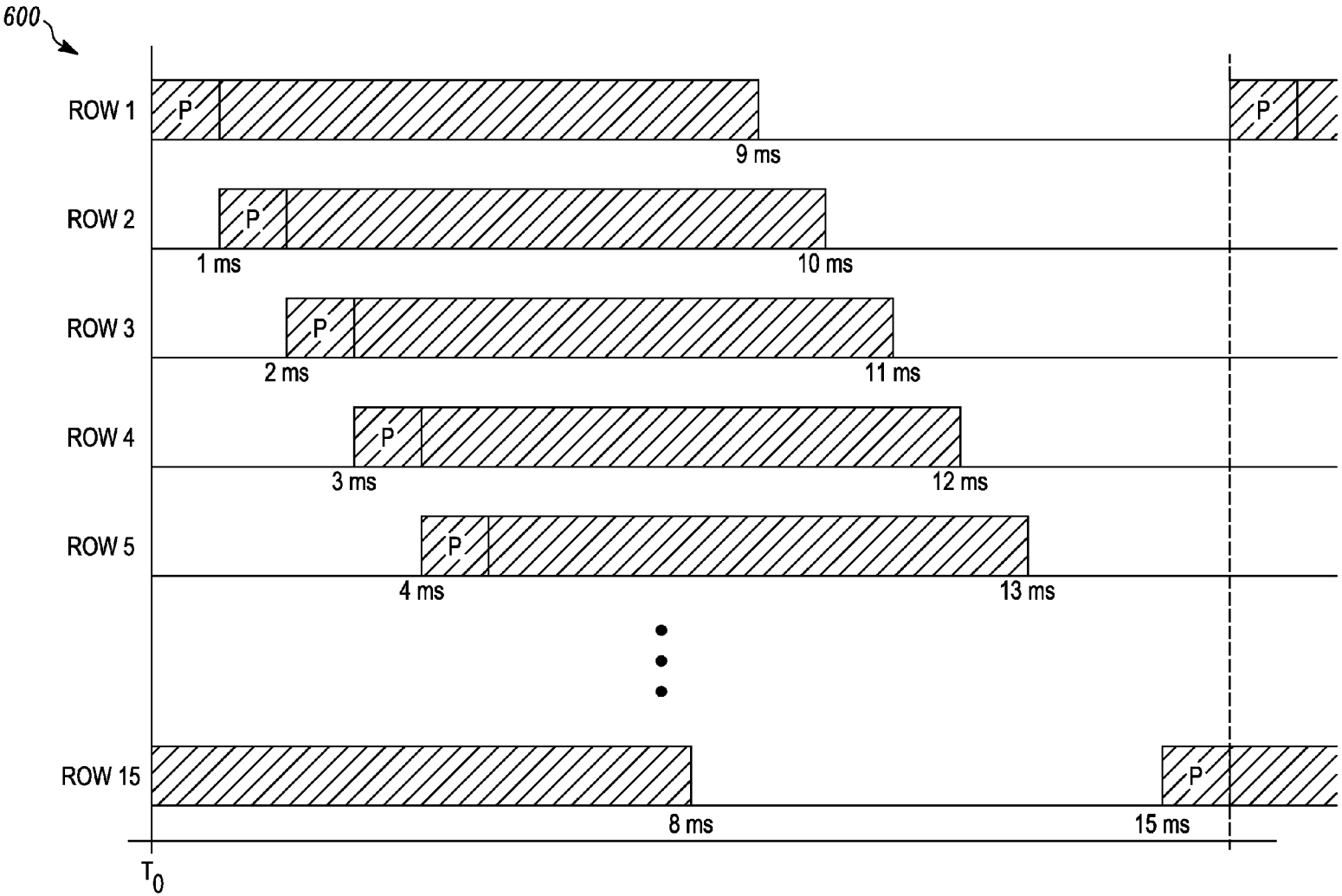
FIG. 6 is an exemplary timing diagram of the AMLED display of FIG. 5.

FIG. 6 is an exemplary timing diagram 600 for AMLED display 550. In FIG. 6, each row 515 is illuminated for the same amount of time (e.g., 9 ms) as enabled by the PWM pulse supplied to each row by its respective PWM 575. Synchronization of the PWMs 575 ensures that all pixels in each row are turned ON for the desired amount of time (e.g. 9 ms) and not turned during the programming time of any row.

Figure 5:
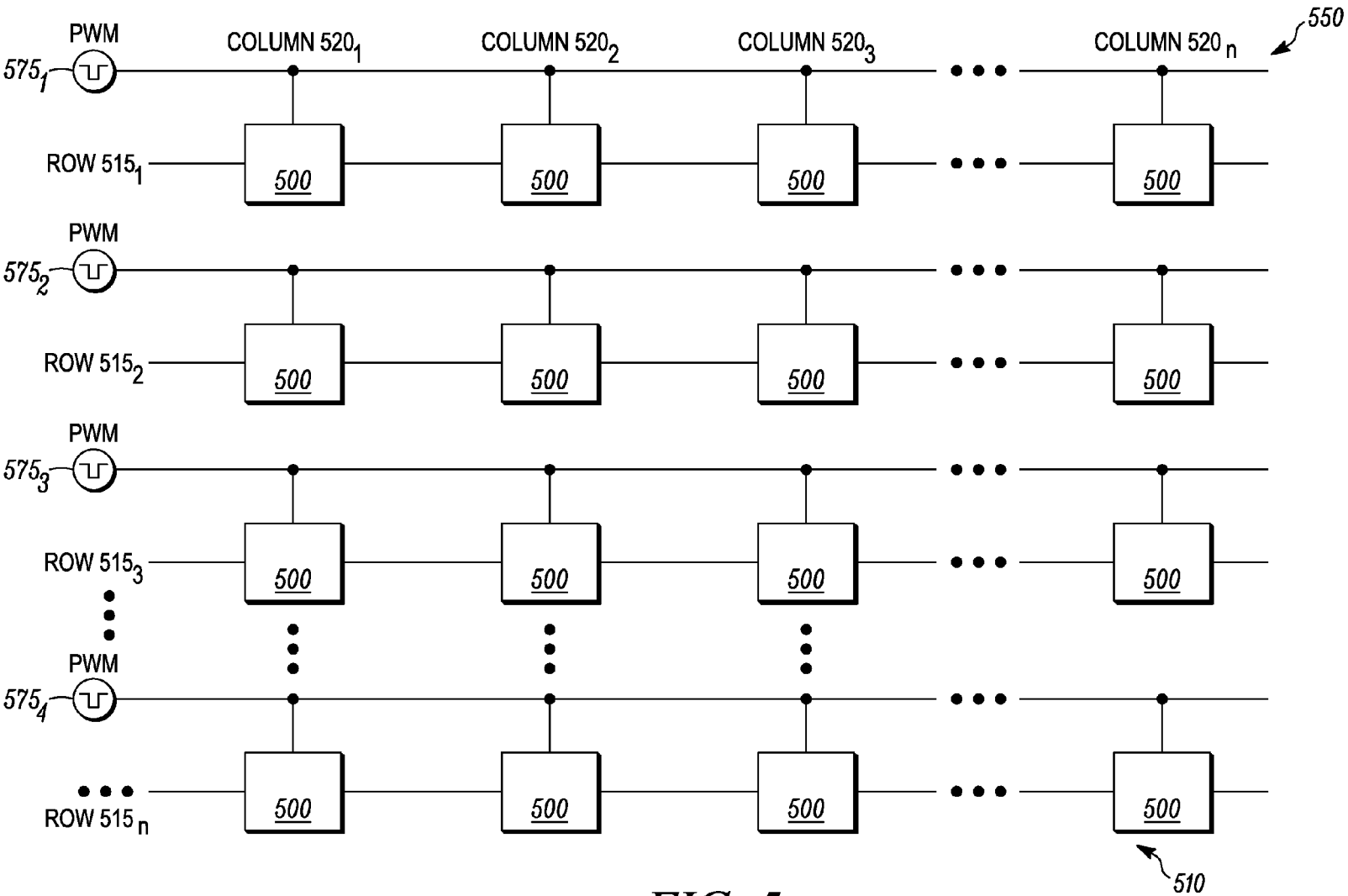
FIG. 5 is a schematic diagram of one exemplary embodiment of an AMLED display comprising an array of the pixels of FIG. 3 or FIG. 4 arranged in a plurality of rows and columns.

The above example is not intended to limit the invention to a display comprising 15 rows and/or the timing scheme (1.0 ms intervals, an illumination time of 9 ms, etc.) disclosed with reference to FIGS. 3-5. Instead, one skilled in the art is able to apply the principles disclosed with reference to FIGS. 3-5 for a display comprising any number of rows and/or an infinite number of timing schemes.

Figure 7:
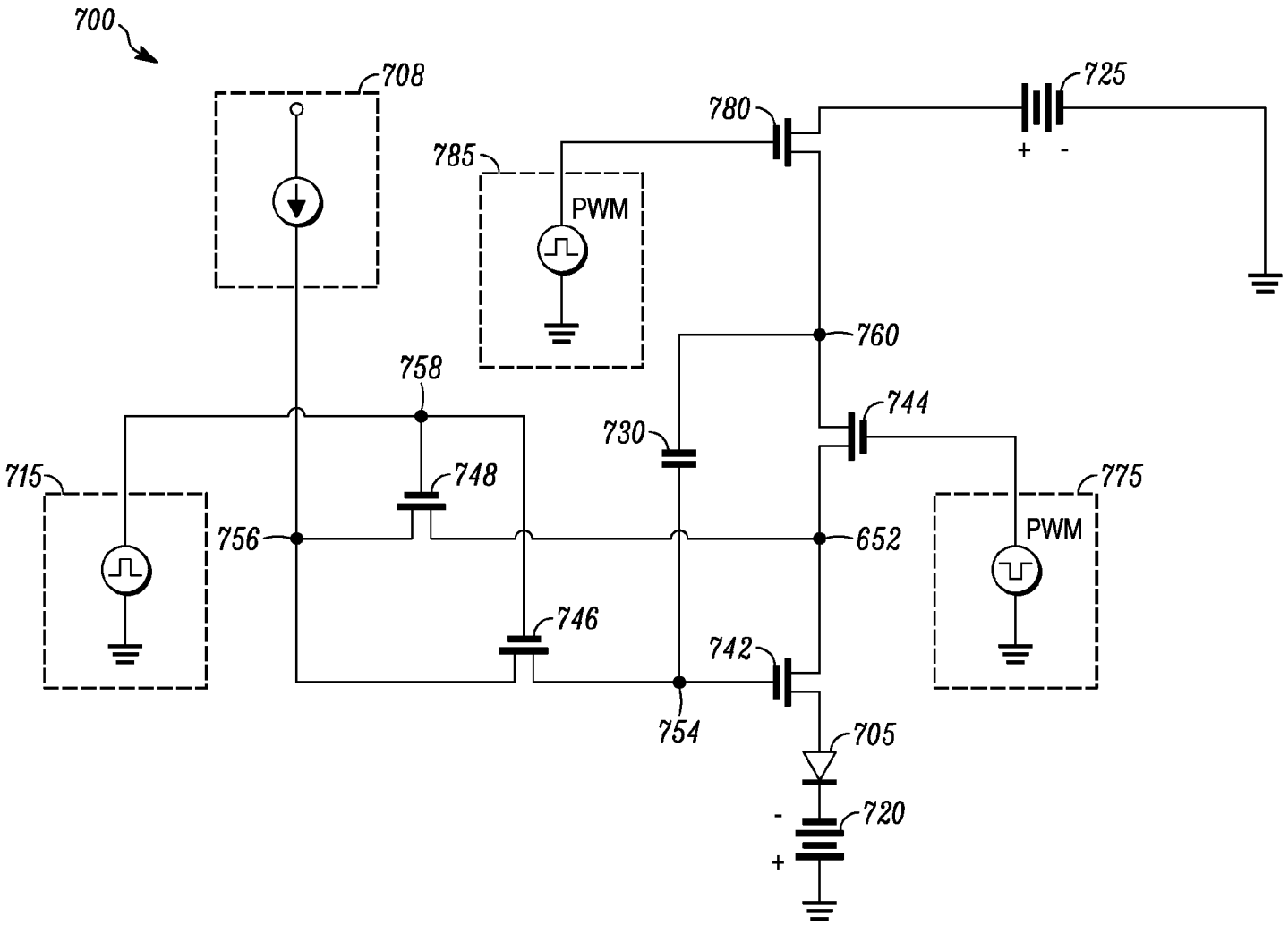
FIG. 7 is a schematic diagram of a pixel of an AMLED display in accordance an exemplary embodiment of the invention.

FIG. 7 is a schematic diagram of one exemplary embodiment of a pixel 700 of an AMLED display that employs an additional illumination period during the blanking period in which no pixels 700 are being programmed. Pixel 700 includes an LED 705 (e.g., an organic LED or other type of LED), a column driver 708, a row driver 715, voltage sources 720 and 725, a capacitor 730, switches 742, 744, 746, and 748 (e.g., semiconductor switches), and a PWM 775 arranged similar to LED 305, column driver 308, row driver 315, voltage sources 320 and 325, capacitor 330, switches 342, 344, 346, and 348, and PWM 375 of FIG. 3, respectively.

Pixel 700 also includes a switch 780 (e.g., a semiconductor switch) coupled between voltage source 725 and node 760, and coupled to a global PWM 785. PWM 785 is configured to switch ON/OFF switch 780 so that current from voltage source 725 is able to flow to LED 705. In accordance with one exemplary embodiment, PWM 785 is configured to turn ON switch 780 for at least a portion of the blanking period. That is, current is supplied to LED 705 from voltage source 725 during the blanking period when no pixels are being programmed, so that LED 705 is illuminated during the blanking period. Furthermore, PWM 785 is a global PWM because PWM 785 turns ON a switch 780 for each pixel 700 on a display, as will be discussed further below, during the blanking period.

Figure 8:
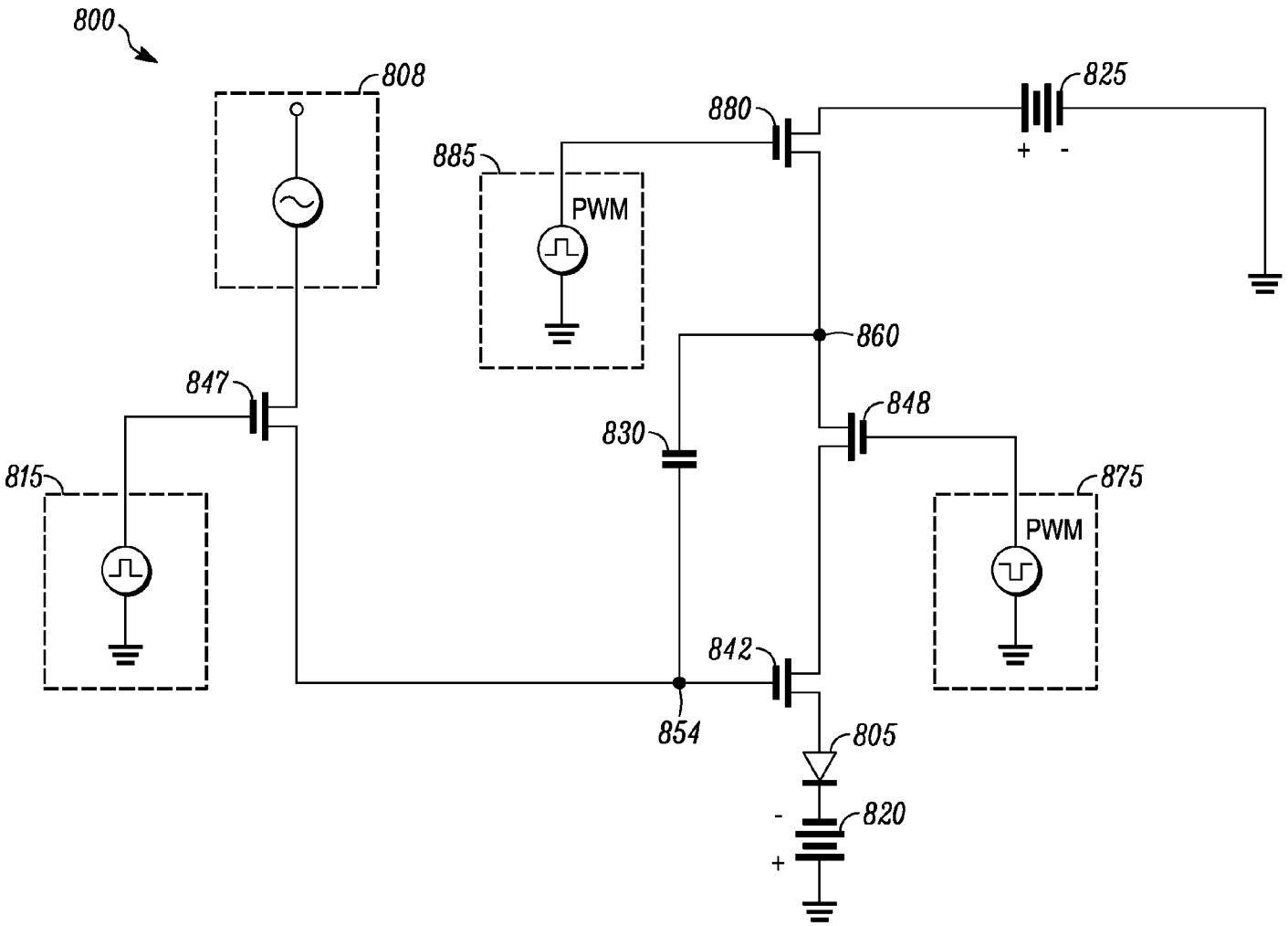
FIG. 8 is a schematic diagram of a pixel of an AMLED display in accordance with another exemplary embodiment of the invention.

FIG. 8 is a schematic diagram of one exemplary embodiment of a pixel 800 of an AMLED display. Pixel 800 includes an LED 805 (e.g., an organic LED or other type of LED), voltage sources 820 and 825, a capacitor 830, switches 842 and 848 (e.g., semiconductor switches), a PWM 875, and a global PWM 885 arranged similar to LED 705, voltage sources 720 and 725, capacitor 730, switches 742 and 744, PWM 775, and global PWM 785 of FIG. 7, respectively.

Pixel 800 also includes a switch 847 (e.g., a semiconductor switch) coupled to node 854. Switch 847 is also coupled to and turned ON/OFF by a row driver 815 similar to row driver 415 (see FIG. 4). Furthermore, switch 847 is coupled to a column driver 808 similar to column driver 408 (see FIG. 4) and configured to enable voltage from column driver 808 to charge capacitor 830 and activate switch 842 (via node 854) when switch 847 is ON. The operation of pixel 800 is similar to that of pixel 400.

Figure 9:
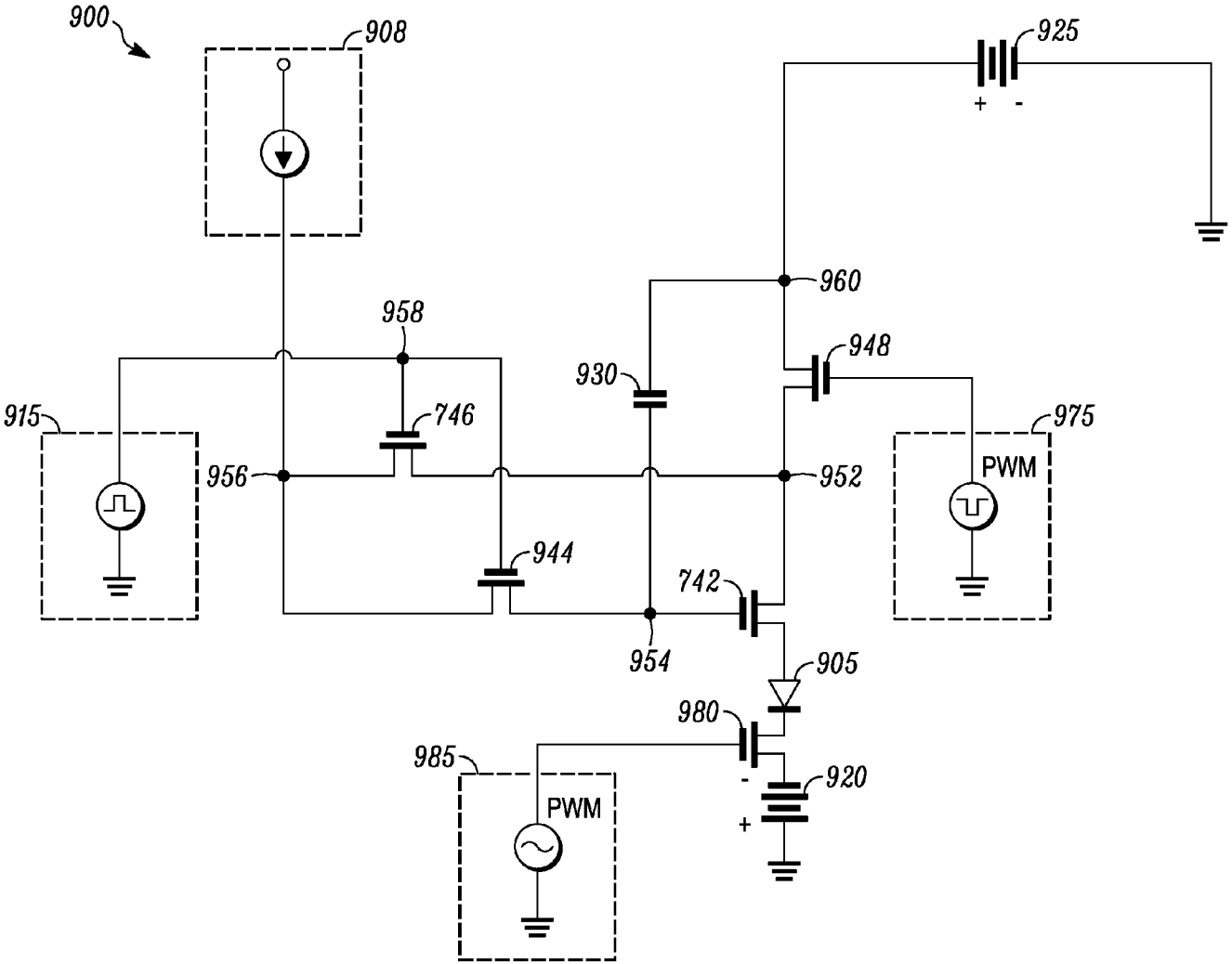
FIG. 9 is a schematic diagram of a pixel of an AMLED display in accordance with one exemplary embodiment of the invention.

FIG. 9 is a schematic diagram of one exemplary embodiment of a pixel 900 of an AMLED display. Pixel 900 includes an LED 905 (e.g., an organic LED or other type of LED), a column driver 908, a row driver 915, voltage sources 920 and 925, a capacitor 930, switches 942, 944, 946, and 948 (e.g., semiconductor switches) and a PWM 975 arranged similar to LED 305, column driver 308, row driver 315, voltage sources 320 and 325, capacitor 330, switches 342, 344, 346, and 348, and PWM 375 of FIG. 3, respectively.

Figure 13:
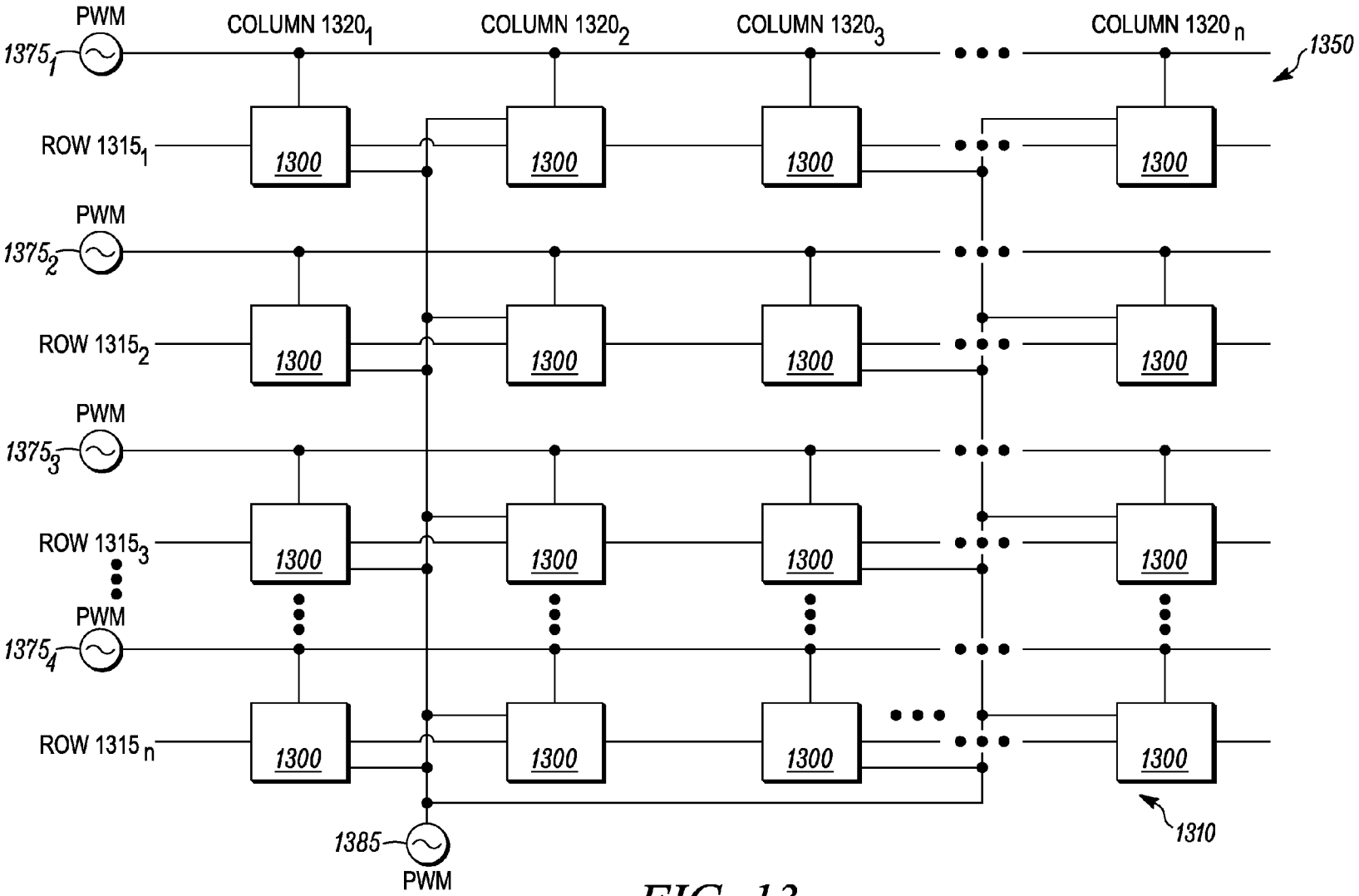
FIG. 13 is a schematic diagram of one exemplary embodiment of an AMLED display comprising an array of the pixels of FIGS. 7, 8, 9, 10, 11, or 12 arranged in a plurality of rows and columns.

Pixel 900 also includes a switch 980 (e.g., a semiconductor switch) coupled between LED 905 and voltage source 920, and coupled to a global PWM 985. PWM 985 is configured to turn ON/OFF switch 980 so that current into voltage source 920 is able to flow through LED 905. In accordance with one exemplary embodiment, PWM 985 is configured to turn ON switch 980 for at least a portion of the blanking period. That is, current flows through LED 905 to voltage source 920 during the blanking period so that LED 905 is illuminated during the blanking period. Furthermore, PWM 985 is a global PWM because PWM 985 turns ON switch 980 for each pixel 900 on a display (see e.g., FIG. 13) during the blanking period.

Figure 10:
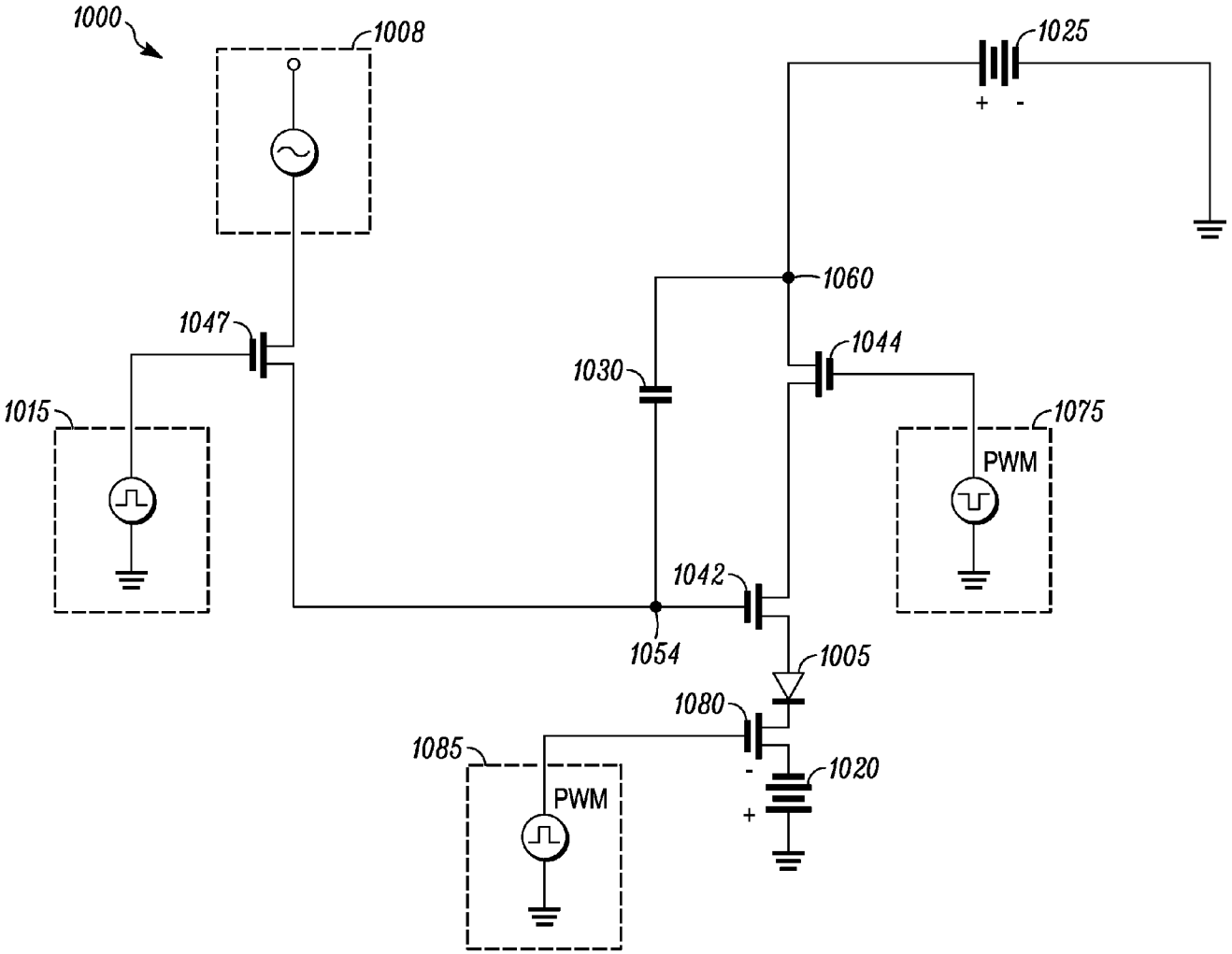
FIG. 10 is a schematic diagram of a pixel of an AMLED display in accordance with another exemplary embodiment of the invention.

FIG. 10 is a schematic diagram of one exemplary embodiment of a pixel 1000 of an AMLED display. Pixel 1000 includes an LED 1005 (e.g., an organic LED or other type of LED), voltage sources 1020 and 1025, a capacitor 1030, and switches 1042 and 1044 (e.g., semiconductor switches), a PWM 1075, and a global PWM 1085 arranged similar to LED 405, voltage sources 420 and 425, capacitor 430, switches 442 and 444, PWM 475, and global PWM 485 of FIG. 4, respectively.

Pixel 1000 also includes a switch 1047 (e.g., a semiconductor switch) coupled to node 1054. Switch 1047 is also coupled to and turned ON/OFF by a row driver 1015 similar to row driver 415 (see FIG. 4). Furthermore, switch 1047 is coupled to a column driver 1008 similar to column driver 408 (see FIG. 4) and configured to enable voltage from column driver 1008 to charge capacitor 1030 and activate switch 1042 (via node 1054) when switch 1047 is ON.

Figure 11:
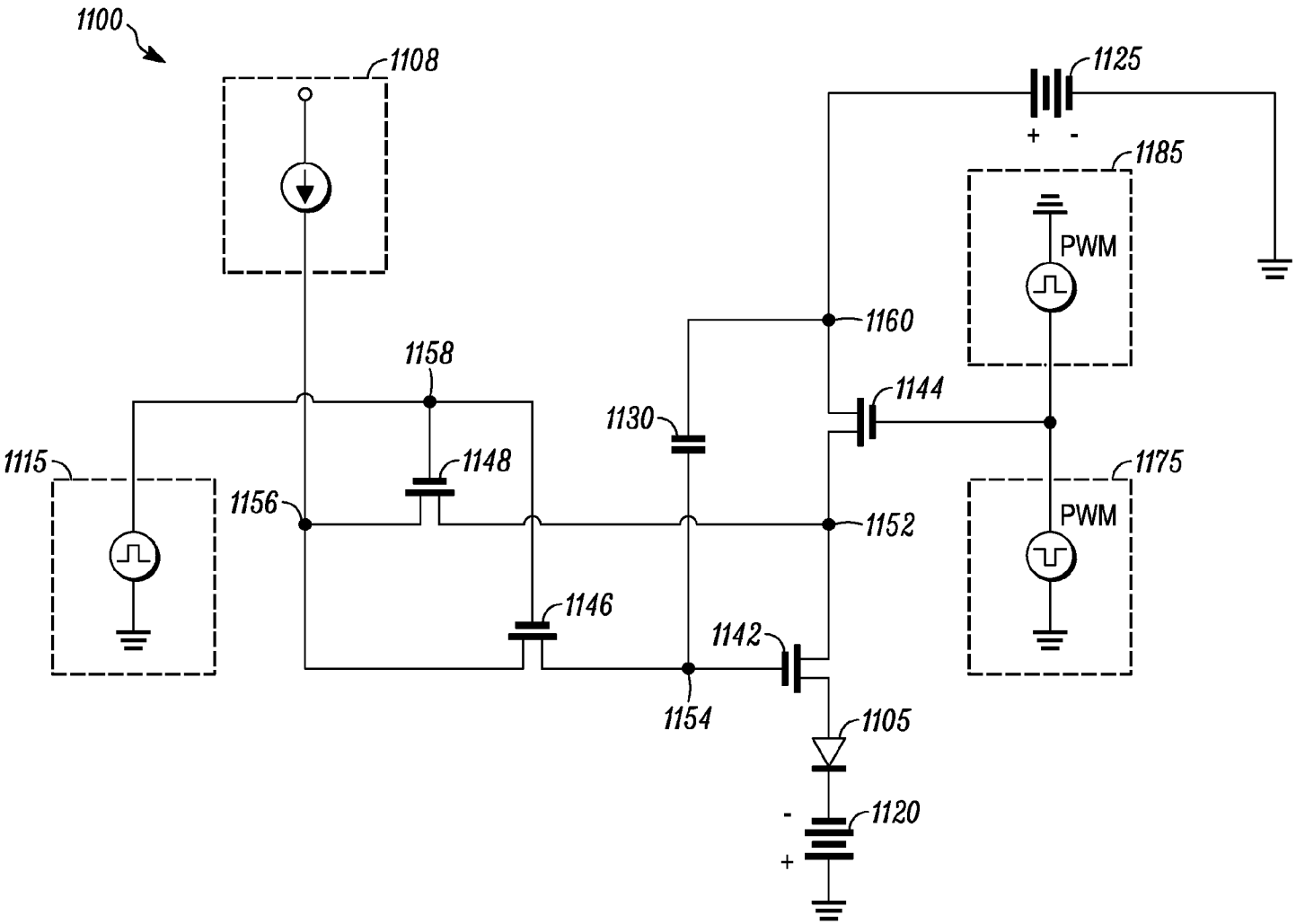
FIG. 11 is a schematic diagram of a pixel of an AMLED display in accordance with an exemplary embodiment of the invention.

FIG. 11 is a schematic diagram of one exemplary embodiment of a pixel 1100 of an AMLED display. Pixel 1100 includes an LED 1105 (e.g., an organic LED or other type of LED), a column driver 1108, a row driver 1115, voltage sources 1120 and 1125, a capacitor 1130, switches 1142, 1144, 1146, and 1148 (e.g., semiconductor switches) and a PWM 1175 arranged similar to LED 305, column driver 308, row driver 315, voltage sources 320 and 325, capacitor 330, switches 342, 344, 346, and 348, and PWM 375 of FIG. 3, respectively.

Pixel 1100 also includes a global PWM 1185 coupled to switch 1144. PWM 1185 is configured to turn ON/OFF switch 1144 so that current from voltage source 1125 is able to flow to LED 1105. In accordance with one exemplary embodiment, PWM 1185 is configured to turn ON switch 1144 for at least a portion of the blanking period. That is, current is supplied to LED 1105 from voltage source 1125 during the blanking period so that LED 1105 is illuminated during the blanking period. Furthermore, PWM 1185 is a global PWM because PWM 1185 turns ON switch 1144 for each pixel 1100 on a display (see e.g., FIG. 13) during the blanking period.

Figure 12:
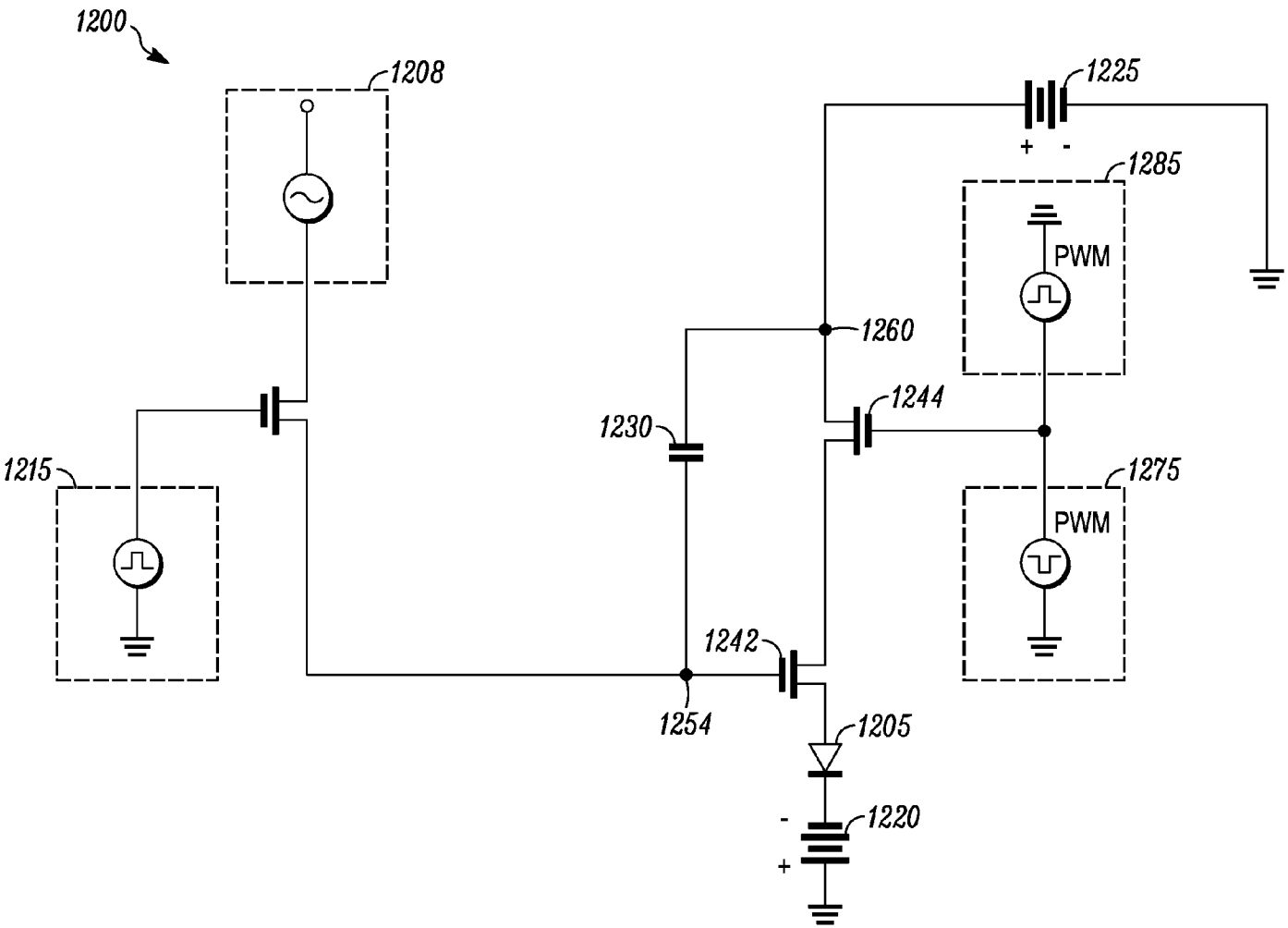
FIG. 12 is a schematic diagram of a pixel of an AMLED display in accordance with another exemplary embodiment of the invention.

FIG. 12 is a schematic diagram of one exemplary embodiment of a pixel 1200 of an AMLED display. Pixel 1200 includes an LED 1205 (e.g., an organic LED or other type of LED), voltage sources 1220 and 1225, a capacitor 1230, and switches 1242 and 1244 (e.g., semiconductor switches), a PWM 1275, and a global PWM 1285 arranged similar to LED 405, voltage sources 420 and 425, capacitor 430, switches 442 and 444, PWM 475, and global PWM 485 of FIG. 4, respectively.

Pixel 1200 also includes a switch 1247 (e.g., a semiconductor switch) coupled to node 1254. Switch 1247 is also coupled to and turned ON/OFF by a row driver 1215 similar to row driver 415 (see FIG. 4). Furthermore, switch 1247 is coupled to a column driver 1208 similar to column driver 408 (see FIG. 4) and configured to enable voltage from column driver 1208 to charge capacitor 1230 and activate switch 1242 (via node 1254) when switch 1247 is ON.

Various embodiments of the invention also provide an AMLED display 1350 (see FIG. 13) comprising an array 1310 of pixels 1300 (e.g., pixels 600, 700, 800, 900, 1000, 1100, and 1200). Array 1310 is arranged in a plurality of rows 1315 and columns 1320. The illumination of each row 1315 is controlled by a different PWM 1375 (e.g., PWMs 675, 775, 875, 975, 1075, 1175, and 1275), and is illuminated one row at a time. In contrast to conventional displays, each PWM 1375 is configured to illuminate each row 1315 for the same amount of time at different times in the display's refresh cycle, in accordance with the rows' programming interval. Furthermore, a global PWM 1385 (e.g., PWMs 685, 785, 885, 985, 1085, 1185, and 1285) is configured to illuminate each pixel 1300 of each row 1315 for at least a portion of the blanking period.

For example, a display comprising 15 rows of pixels 1300 illuminates a row every 1.0 ms via the PWM 1375 for each respective row. That is, row $\mathbf{1315}_1$ may be illuminated at time $T_0$ for 13 ms (i.e., until 13 ms after $T_0$) by PWM $\mathbf{1375}_1$. At time $T_1$ (i.e., 1.0 ms after $T_0$), row $\mathbf{1315}_2$ is illuminated for 13 ms (i.e., until 14 ms after $T_0$) by PWM $\mathbf{1375}_2$. This process continues until row $\mathbf{1315}_{15}$ is illuminated at $T_{15}$ (e.g., 14 ms after $T_0$) for 13 ms (i.e., 27 ms after $T_0$ or 11 ms after the beginning of the next display cycle time) by PWM $\mathbf{1375}_{15}$. During the blanking period (at the end of the display's cycle time) each pixel 1300 is turned OFF, and global PWM 1385 (e.g., PWMs 685, 785, 885, 985, 1085, 1185, and 1285) illuminates each pixel 1300 for at least a portion (e.g., 0-1.0 ms) of the blanking period.

Figure 14:
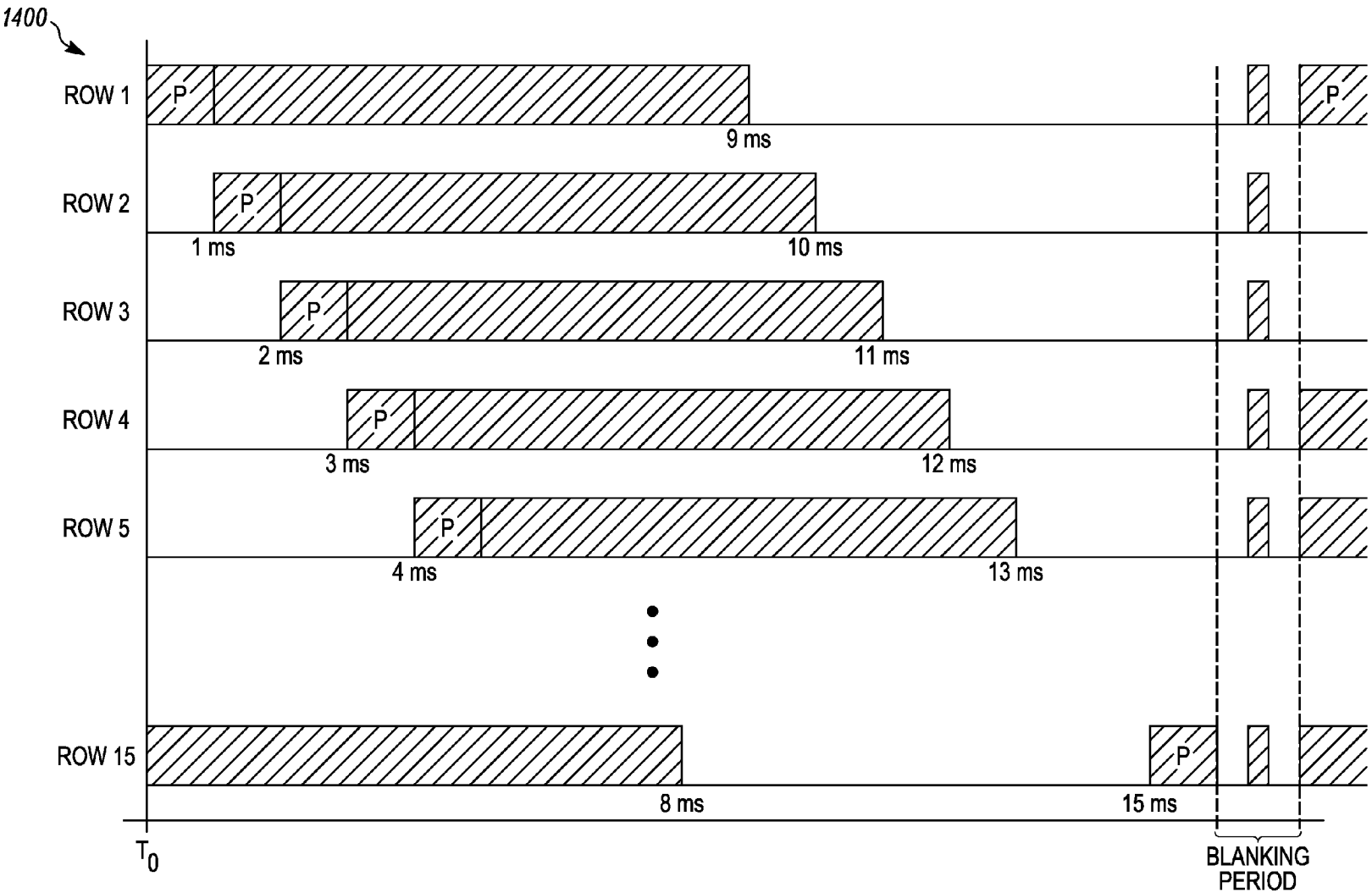
FIG. 14 is an exemplary timing diagram of the AMLED display of FIG. 13.

FIG. 14 is an exemplary timing diagram 1400 for AMLED display 1300. In FIG. 14, each row 1315 is illuminated for the same amount of time (e.g., 9 ms), though the starting and ending times of each row 1315 are different. During the blanking period, pixels 1300 are each are turned OFF, and global PWM 1385 (e.g., PWMs 685, 785, 885, 985, 1085, 1185, and 1285) then illuminates each pixel 1300 for at least a portion (e.g., 0.2 ms) of the 0.6 ms blanking period.

Figure 15:
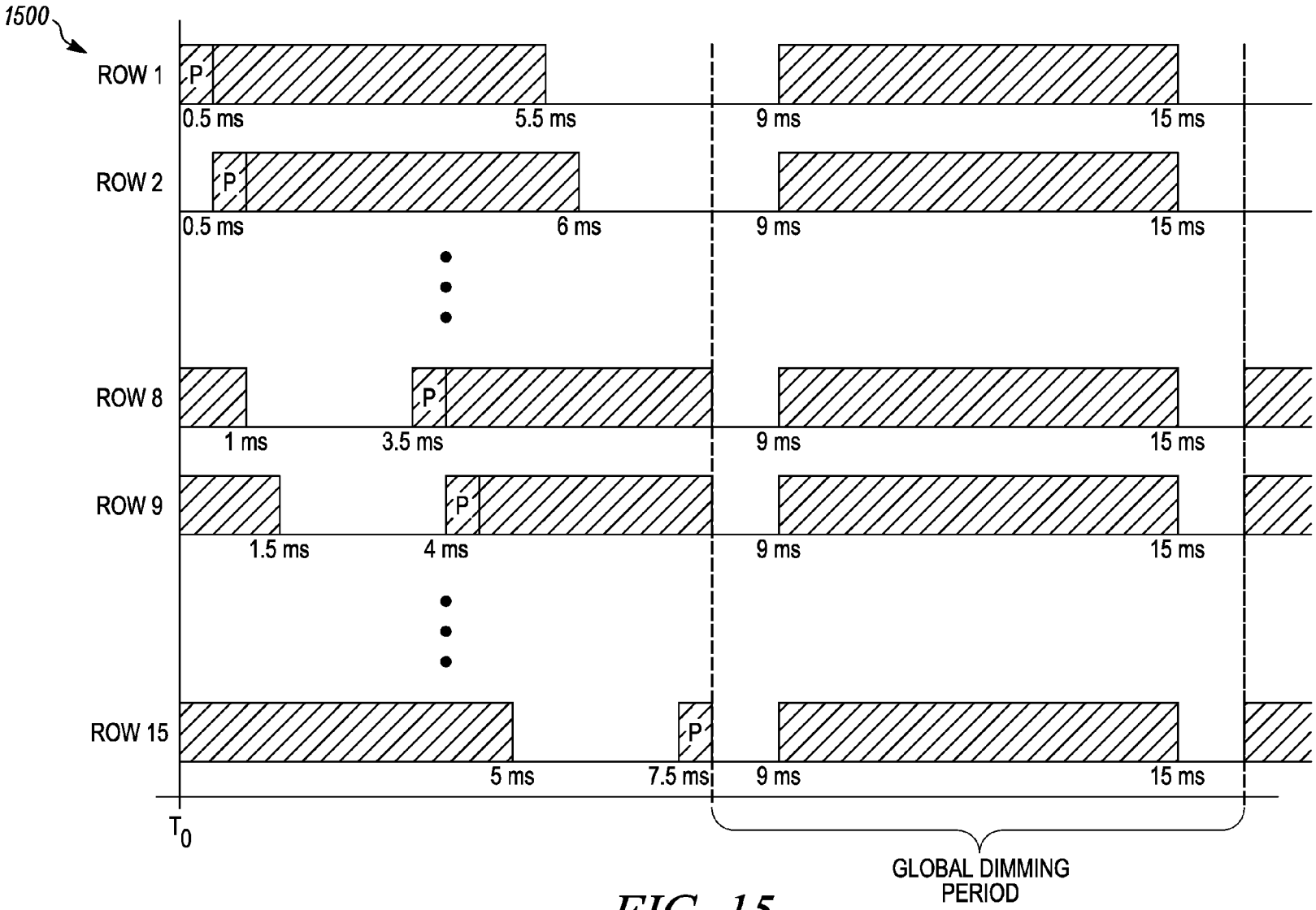
FIG. 15 is another exemplary timing diagram of the AMLED display of FIG. 13.

FIG. 15 is another exemplary timing diagram 1500 AMLED for display 1300. In FIG. 15, the display cycle time is divided into a plurality portions (e.g., an 8.6 ms portion and an 8 ms portion). Each row 315 is illuminated for a fraction (e.g., 5.5 ms) of the first portion, though the starting and ending times of each row 1315 are different.

The second portion (representing a lengthened blanking period) is used as a global dimming interval. During the global dimming interval, pixels 1300 are each turned OFF, and global PWM 1385 (e.g., PWMs 685, 785, 885, 985, 1085, 1185, and 1285) then illuminates each pixel 1300 for at least a portion (e.g., 6 ms) of the 8.6 ms second portion.

The above examples do not limit the invention to a display comprising 15 rows and/or the timing scheme (e.g., 1.0 ms or 0.5 ms intervals, a 0.6 ms or 8.6 ms blanking period, a 16.6 ms display cycle time, 5.5 ms or 9 ms illumination periods, etc.) disclosed with reference to FIGS. 6-15. Instead, one skilled in the art is able to apply the principles disclosed in FIGS. 6-15 for a display comprising any number of rows and/or an infinite number of timing schemes.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

We claim:

1. A pixel in a row of pixels of an active matrix light-emitting diode (AMLED) display with a refresh cycle time, comprising:

a first switch coupled in series between a voltage source and a ground;

a second switch, the second switch coupled in series with the first switch;

a light-emitting diode (LED) coupled in series between the first and second switches and the ground;

a first pulse-width modulation (PWM) driver configured to energize the LED for a first specified time period by operating the first switch in a staggered fashion after the passage of a second time period that is equal to a multiple of a pixel row programming time delay, the multiple of a pixel row programming timing delay extending from the energizing of an LED illuminating a pixel in a previous row; and a second PWM driver configured to extinguish the LED by operating the second switch after the first specified time period has elapsed, the first specified time period being less than the refresh cycle time.

2. The pixel of claim 1, wherein the first switch and the second switch are coupled between the voltage source and the LED.

3. The pixel of claim 1, wherein the first switch is coupled between the voltage source and the LED, and the second switch is coupled between the LED and ground.

4. The pixel of claim 1, wherein the first PWM driver and the second PWM driver are configured to both operate one of the first switch and the second switch.

5. A system for dimming an array of pixels on an active matrix light-emitting diode display operating on a refresh cycle including a voltage source and ground, the system comprising:

a plurality of LEDs forming a plurality of rows coupled between the voltage source and ground;

a plurality of pulse-width modulation (PWM) drivers, one of the plurality of PWM drivers being coupled to each of the LEDs in one of the plurality of rows and configured to energize one of the plurality of LEDs during a specified portion of the refresh cycle, wherein energizing each LED in a different row of LEDs is staggered by a multiple of a row programming time delay from the energizing of a previous row; and a global PWM driver coupled to each of the plurality of LEDs in each of the plurality of rows, the global PWM configured to simultaneously energize each of the plurality of LEDs during at least a portion of a blanking period.

6. The system of claim 5, wherein each of the plurality of PWM drivers is coupled between the voltage source and each of the plurality of LEDs, and the global PWM driver is coupled between the voltage source and each of the plurality of LEDs.

7. The system of claim 5, wherein each of the plurality of PWM drivers is coupled between the voltage source and each of the plurality of LEDs, and the global PWM driver is coupled between each of the plurality of LEDs and ground.

8. The system of claim 5, further comprising a plurality of switches coupled between the voltage source and each of the plurality of LEDs, wherein each of the plurality of PWM drivers are and the global PWM driver is coupled to each of the plurality of switches.

9. A method for dimming an array of pixels forming a plurality of rows on an active matrix light-emitting diode display, the method comprising the steps of:

providing current to the plurality of rows in a staggered fashion, wherein the current is provided to each LED of a first row of LEDs for a first portion of a refresh cycle via a first pulse-width modulation (PWM) driver; and providing current to each LED of the first row for a second portion of the refresh cycle via a second PWM driver, wherein the second portion of the refresh cycle is a period wherein no pixels are being programmed.

10. The method of claim 9, further comprising the step of providing current to each LED of a second row of LEDs for a third portion of the refresh cycle via a third PWM driver.

11. The method of claim 10, further comprising the step of providing current to each LED of the second row for the second portion of the refresh cycle via the second PWM driver.

12. The method of claim 11, wherein current is provided to each LED of the first and second rows at substantially the same time during the second portion of the refresh cycle.

13. The method of claim 10, further comprising the step of programming the first PWM driver and the third PWM driver to cease providing current prior to the second portion of the refresh cycle.

14. The method of claim 10, wherein a beginning of the first portion of the refresh cycle and a beginning of the third portion of the refresh cycle occur at different times.

* * * * *